US006554782B2

(12) United States Patent
Robbins, III et al.

(10) Patent No.: US 6,554,782 B2
(45) Date of Patent: Apr. 29, 2003

(54) CHAIRMAT WITH FOOT MASSAGE AREA

(75) Inventors: Edward S. Robbins, III, 2802 E. Avalon Ave., Muscle Shoals, AL (US) 35662; Bobby Keith Rhodes, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 122 days.

(21) Appl. No.: 09/765,391

(22) Filed: Jan. 22, 2001

(65) Prior Publication Data

US 2002/0111574 A1 Aug. 15, 2002

(51) Int. Cl.[7] ..... A61H 7/00

(52) U.S. Cl. ..... 601/28; 601/136; 601/138; 428/120

(58) Field of Search ..... 601/27, 28, 136, 601/138; 428/43, 120; 15/215, 216, 217, 238, 241

(56) References Cited

U.S. PATENT DOCUMENTS

| | | | | | |
|---|---|---|---|---|---|
| 1,931,146 | A | | 10/1933 | Hampel | |
| 1,954,940 | A | * | 4/1934 | Mikel | 15/215 |
| 1,981,379 | A | | 11/1934 | Thomson et al. | |
| 2,465,725 | A | | 3/1949 | Herzmark | |
| 2,476,921 | A | | 7/1949 | Shock | |
| 2,602,724 | A | * | 7/1952 | Batchelor | 15/238 |
| 2,820,454 | A | | 1/1958 | Wright | |
| 3,100,483 | A | | 8/1963 | Altmeyer et al. | |
| 3,434,715 | A | | 3/1969 | Brantingham et al. | |
| 3,648,320 | A | * | 3/1972 | Woolley | 15/217 |
| 3,885,555 | A | | 5/1975 | Nobbs | |
| 3,911,520 | A | * | 10/1975 | Tupper | 15/216 |
| 4,003,372 | A | | 1/1977 | Willoby | |
| 4,329,981 | A | | 5/1982 | Dungl | |
| 4,420,180 | A | * | 12/1983 | Dupont et al. | 15/215 |
| 4,435,451 | A | | 3/1984 | Neubert | |
| 4,509,510 | A | | 4/1985 | Hook | |
| 4,715,743 | A | | 12/1987 | Schmanski | |
| 4,784,888 | A | | 11/1988 | Schwertner et al. | |
| 4,813,405 | A | | 3/1989 | Filip | |
| 4,936,294 | A | | 6/1990 | Chu | |
| 5,158,073 | A | | 10/1992 | Bukowski | |
| 5,186,703 | A | | 2/1993 | Huang | |
| 5,254,384 | A | * | 10/1993 | Gordon | 428/120 |
| 5,293,660 | A | * | 3/1994 | Park | 15/215 |
| 5,362,544 | A | * | 11/1994 | Reuben | 15/215 |
| 5,490,821 | A | | 2/1996 | Wu | |
| 5,575,034 | A | | 11/1996 | Biernacinski et al. | |
| 5,628,079 | A | | 5/1997 | Kizemchuk et al. | |
| 5,735,804 | A | | 4/1998 | Chan | |
| 5,830,163 | A | | 11/1998 | Obermaier | |
| 5,996,160 | A | * | 12/1999 | Pruitt | 15/216 |
| 6,171,269 | B1 | | 1/2001 | Norin | |
| 6,177,165 | B1 | | 1/2001 | Robbins, III et al. | |
| 6,183,833 | B1 | | 2/2001 | Robbins, III et al. | |

* cited by examiner

*Primary Examiner*—Danton D. DeMille
(74) *Attorney, Agent, or Firm*—Nixon & Vanderhye P.C.

(57) ABSTRACT

A desk chairmat includes a substantially planar member having an upper surface, a lower surface, and a peripheral edge; and a plurality of foot massage nodules projecting upwardly from the upper surface located in a selected area of the planar member.

20 Claims, 2 Drawing Sheets

CHAIRMAT WITH FOOT MASSAGE AREA

BACKGROUND AND SUMMARY OF THE INVENTION

Desk chairmats are well known in the art and typically include a substantially planar member of generally square, rectangular or other shape, with or without a lip extension portion adapted to be located in the well area of a desk. Typical chairmats for use on carpeted floors also include a plurality of spikes or cleats that anchor the chairmat and prevent drifting.

Foot massage mats are also known in the art, typically including relatively small, generally square, oval or rectangular mats of rubber or plastic construction, with an array of protuberances covering substantially the entire upper surface of the mat. Examples may be found in U.S. Pat. Nos. 5,575,034; 5,158,073; and 4,329,981.

This invention advantageously combines a desk chairmat with a foot massage mat to permit persons sitting at a desk to massage the soles of the feet in, for example, an office or home office environment.

In one exemplary embodiment, the invention provides a desk chairmat that includes a planar member with four side edges and a lip extension projecting from the forward edge of the mat. The lip extension is formed with a recess, and a plurality of therapeutic nodules or protuberances projecting upwardly from the base of the recess, such that the protuberances or nodules do not extend substantially above the upper surface of the remainder of the chairmat. The nodules or protuberances are preferably of part-spherical shape but may have other shapes as well.

The chairmat is preferably of unitary construction, and is preferably made of a transparent or semi-transparent PVC, polypropylene, polycarbonate, or other suitable material.

It should be understood that the shape of the chairmat is not limited to square or rectangular and may include round, oval or other shapes. Moreover, the foot massage area may be included in an extended lip portion of the chairmat, or in a selected area within an otherwise regular peripheral border or edge of the chairmat.

Accordingly, in one aspect, the invention relates to a desk chairmat comprising a substantially planar member having an upper surface, a lower surface, and a peripheral edge; and a plurality of foot massage nodules projecting upwardly from a selected recessed area of the planar member.

In another aspect, the present invention relates to a desk chairmat comprising a substantially planar member having an upper surface, a lower surface, four side edges and a lip portion extending from one of the four side edges, the lip portion having a plurality of upwardly projecting foot massage nodules.

In another aspect, the invention relates to a desk chairmat comprising a substantially planar member having an upper surface, a lower surface, four side edges and a lip portion extending from one of the four side edges, the lip portion having a recess formed therein with a base surface surrounded by a peripheral wall; and a plurality of upwardly projecting nodules arranged throughout substantially the entirety of the recess.

Other objects and advantages of the invention will become apparent from the detailed description that follows in connection with the drawings as briefly described below.

DETAILED DESCRIPTION OF THE DRAWINGS

Figure 1:
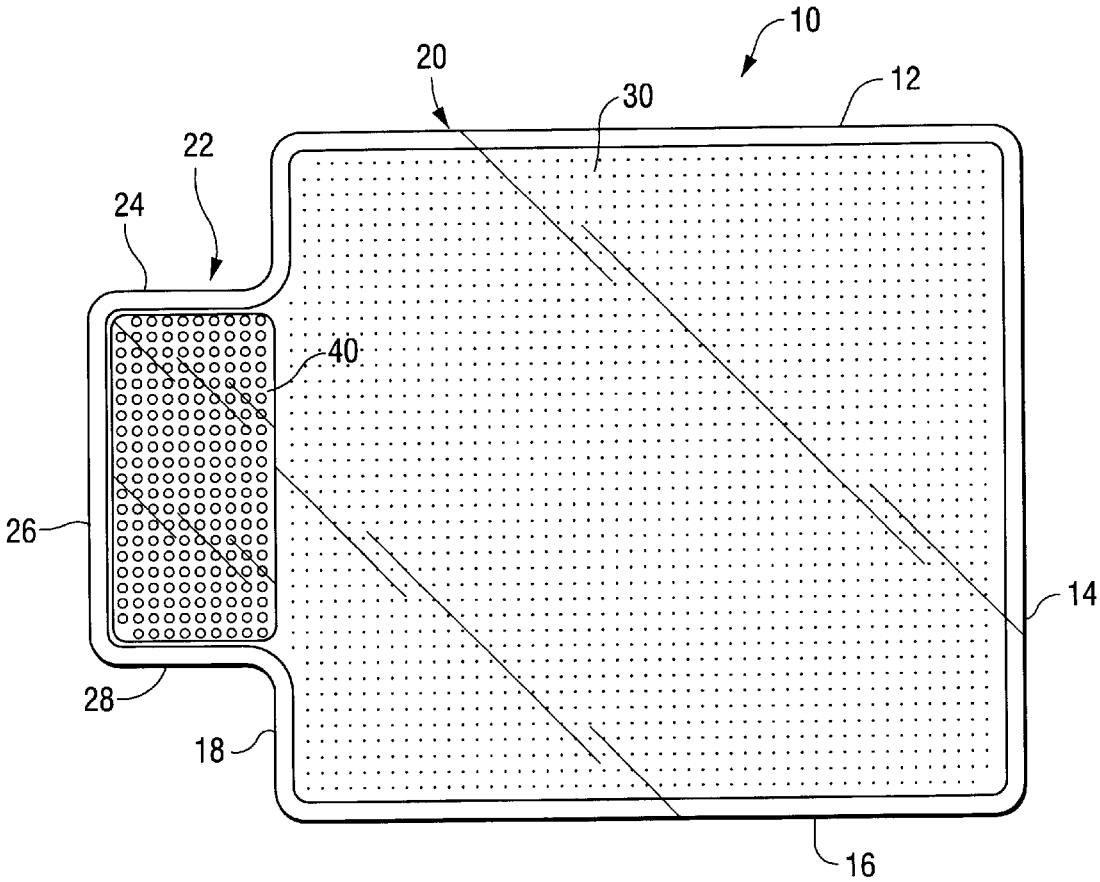
FIG. 1 is a plan view of a desk chairmat in accordance with an exemplary embodiment of the invention.

With reference to FIG. 1, a desk chairmat 10 in accordance with one exemplary embodiment includes a planar member having four side edges 12, 14, 16 and 18 which define a major portion 20 of the chairmat. A lip extension 22 of the same material and thickness, projects or extends integrally from the side edge 12 and is further defined by edges 24, 26 and 28. The lip extension 22, as is well known, is designed to project into the well area of a desk, with the remainder of the chairmat behind the desk and serving as the principal contact area for a desk chair (not shown) typically fitted with rollers or casters. The upper surface 30 of the chairmat is generally smooth, while the lower surface 32 is formed with a substantial number of relatively short but relatively sharp spikes or cleats 34 which are used to anchor the chairmat to an underlying carpet. As is also well understood in the art, chairmats for use on hard flooring do not require such spikes or cleats.

In accordance with this invention, the lip extension area 22 is formed with a generally rectangular recess 36 including a flat base surface 38 surrounded by a beveled edge or wall 40 having rounded corners. The invention is not limited, however, to this shape or edge wall configuration. Within the recess 36, there are a plurality of parallel rows of therapeutic nodules 42. The arrangement of nodules may be varied, i.e., they need not be arranged in parallel rows. The nodules 42 preferably do not extend above the upper surface 30, i.e., the nodules remain within the plane of the mat, but the height may vary as desired.

The nodules 42 are preferably of a part-spherical shape but other shapes, such as, for example, a rounded cone shape, may also be employed. In a preferred arrangement, the nodules have diameters between about ¼" and ½", and are spaced about ⅜"–½" apart. These dimensions may vary, however. The nodules themselves are preferably rigid, particularly when formed in the part-spherical shape. The entire chairmat 10, including the nodules 42, is made of a single plastic composition, preferably PVC, polypropylene, polycarbonate or other suitable material. Nodules 42 thus provide a means for massaging the soles of the feet while seated at a desk.

Note that while the cleats 34 appear to be substantially centered below the nodules 42, there need be no relationship between the location of the nodules 42 and the cleats 34.

Figure 2:
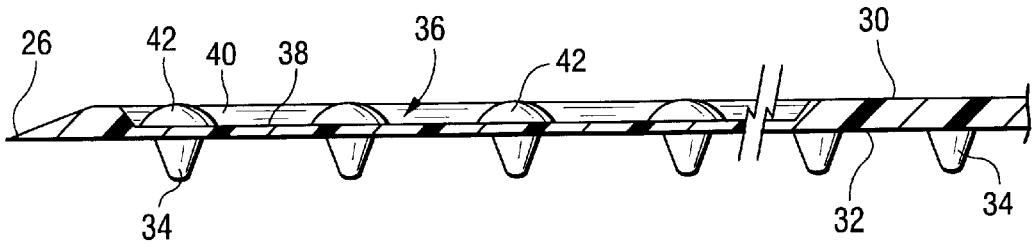
FIG. 2 is a cross section through the foot massage portion of the desk chairmat shown in FIG. 1.
Figure 3:
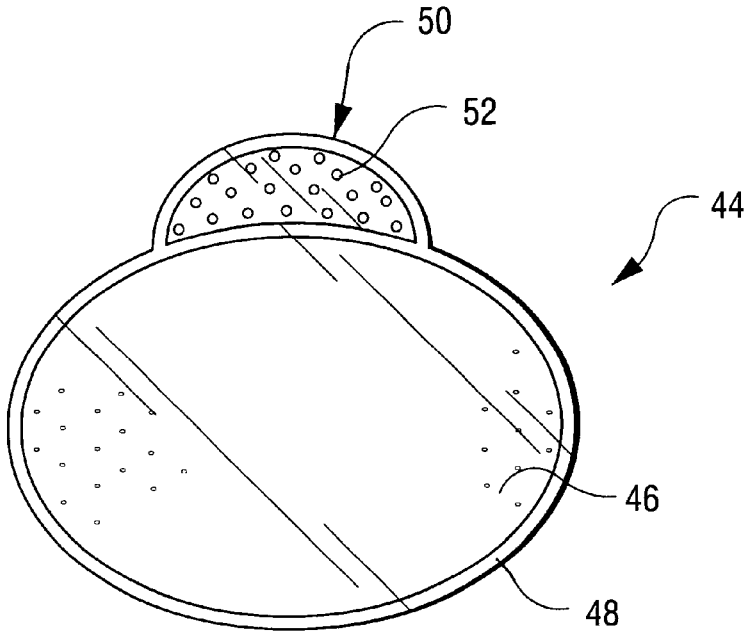
FIG. 3 is a plan view of a desk chairmat in accordance with another embodiment of the invention.

With reference now to FIG. 3, an oval desk chairmat 44 is illustrated, also comprised of a substantially planar body 46, formed with a peripheral beveled edge 48. A rounded lip extension 50 projects away from the remainder of the mat, and this lip extension includes a plurality of massage nodules 52 in a recessed area as otherwise described in connection with the embodiment illustrated in FIGS. 1 and 2.

Figure 4:
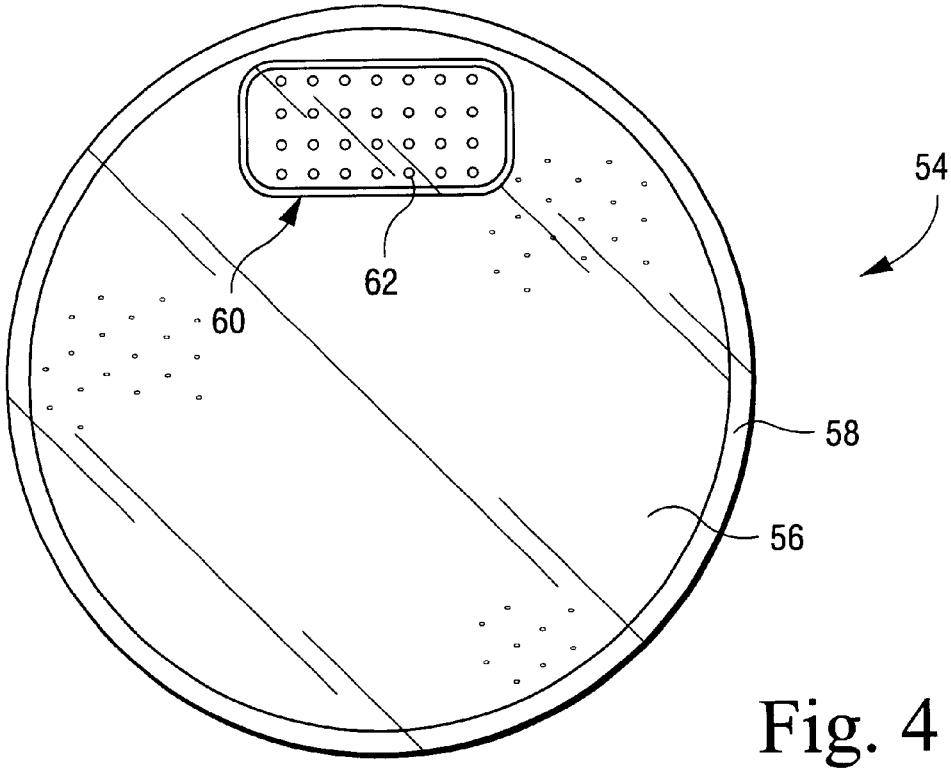
FIG. 4 is a plan view of a desk chairmat in accordance with still another embodiment of the invention.

FIG. 4 illustrates another embodiment of the invention, wherein the desk chairmat 54 is round. The substantially planar body 56 is surrounded by a peripheral beveled edge 58 and a foot massage area 60 is located within the periphery of the mat, with a plurality of foot massage nodules 62 that are similar to those described hereinabove.

It will be understood that the desk chairmat may have any of a variety of shapes and this invention relates to the incorporation of a foot massage area that may be located within the periphery of an otherwise regularly shaped mat, as shown, for example, in FIG. 4, or located in a lip extension to an otherwise regular shape, as in FIGS. 1–3.

In addition, it will be understood by those skilled in the art that the chairmat may incorporate additional features, such as an integral hinge to permit folding and easy transport of the mat; handles; and/or hang tabs as disclosed in various of commonly owned application Ser. Nos. 09/238,737; 09/097,586; and 09/684,967.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A desk chairmat comprising a unitary, substantially planar member made of PVC, polypropylene or polycarbonate material having an a smooth upper surface for supporting a chair and its occupant, a lower surface, four side edges and a lip portion extending from one of said four side edges adapted for location in a well area of a desk, said lip portion having a plurality of upwardly projecting foot massage nodules of part spherical shape.

2. The desk chairmat of claim 1 wherein said plurality of part spherical nodules are located throughout substantially the entirety of said lip portion.

3. The desk chairmat of claim 1 wherein said plurality of part spherical nodules are located within a recessed area such that said nodules do not extend substantially beyond said upper surface.

4. The desk chairmat of claim 1 wherein a plurality of cleats extend downwardly from said lower surface.

5. The desk chairmat of claim 1 wherein said nodules are arranged in parallel rows.

6. The desk chairmat of claim 1 wherein said plurality of nodules are located within a recessed area, and arranged in parallel rows throughout substantially the entirety of said lip portion.

7. The desk chairmat of claim 1 wherein said nodules have diameters between about ¼ and ½ inch.

8. The desk chairmat of claim 1 wherein said nodules are spaced about ⅜–½ inch apart.

9. A desk chairmat comprising a unitary, substantially planar member of PVC, polypropylene or polycarbonate material having a smooth upper surface for supporting a chair and its occupant, a lower surface, four side edges and a lip portion extending from one of said four side edges and adapted to be located in a well area of a desk, said lip portion having a recess formed therein with a base surface surrounded by a peripheral wall; and a plurality of upwardly projecting nodules arranged throughout substantially the entirety of said recess.

10. The desk chairmat of claim 9 wherein said recess extends throughout substantially the entirety of said lip extension.

11. The desk chairmat of claim 9 wherein said nodules are of part-spherical shape.

12. The desk chairmat of claim 9 and including a plurality of cleats extending downwardly from said lower surface.

13. The desk chairmat of claim 9 wherein said nodules are of part-spherical shape, each having a diameter between about ¼ and ½ inch.

14. The desk chairmat of claim 13 wherein said nodules are spaced about ⅜–½ inch apart.

15. A desk chairmat comprising a unitary, substantially planar member made of PVC, polypropylene or polycarbonate material having a smooth upper surface for supporting a chair and its occupant, a lower surface, and a peripheral edge; and a plurality of part spherical foot massage nodules projecting upwardly from a selected recessed area of said planar member, such that said nodules do not extend substantially beyond said upper surface.

16. The desk chairmat of claim 15 wherein said substantially planar member is oval or round in shape.

17. The desk chairmat of claim 15 wherein said selected area is in an outwardly extended lip portion of said planar member.

18. The desk chairmat of claim 15 including a plurality of cleats extending downwardly from said lower surface.

19. The desk chairmat of claim 15 said nodules have diameters between about ¼ and ½ inch.

20. The desk chairmat of claim 15 wherein said nodules are spaced about ⅜–½ inch apart.

* * * * *